US012721390B2

(12) United States Patent
Long

(10) Patent No.: US 12,721,390 B2
(45) Date of Patent: Sep. 1, 2026

(54) HEIGHT-ADJUSTABLE SUPPORTING STRUCTURE USED FOR ARTIFICIAL GREEN PLANT AND COMBINED CONTAINER OF HEIGHT-ADJUSTABLE SUPPORTING STRUCTURE

(71) Applicant: Teng Long, Guangshui (CN)

(72) Inventor: Teng Long, Guangshui (CN)

( * ) Notice: Subject to any disclaimer, the term of this patent is extended or adjusted under 35 U.S.C. 154(b) by 0 days.

(21) Appl. No.: 18/964,456

(22) Filed: Dec. 1, 2024

(65) Prior Publication Data

US 2025/0089828 A1 Mar. 20, 2025

(51) Int. Cl.
*A41G 1/00* (2006.01)

(52) U.S. Cl.
CPC ..... *A41G 1/00* (2013.01)

(58) Field of Classification Search
CPC ..... A41G 1/00
See application file for complete search history.

(56) References Cited

U.S. PATENT DOCUMENTS 1,555,475 A * 9/1925 Maunz ..... A41G 1/00 428/22
6,004,635 A * 12/1999 Li ..... A41G 1/00 47/41.12
2005/0185398 A1* 8/2005 Scannell, Jr. ..... H05B 47/19 362/227
2012/0047801 A1* 3/2012 Hogan ..... A01G 9/022 47/65.5
2014/0196365 A1 7/2014 Washington
2018/0027753 A1 2/2018 Major
2018/0084737 A1 3/2018 Wills

* cited by examiner

*Primary Examiner* — Kim S. Horger
(74) *Attorney, Agent, or Firm* — Hemisphere Law, PLLC

(57) ABSTRACT

A height-adjustable supporting structure used for an artificial green plant and a combined container of the height-adjustable supporting structure are provided, and relate to the technical field of artificial green plants. The height-adjustable supporting structure used for an artificial green plant and the combined container of the height-adjustable supporting structure include an artificial green plant body. The artificial green plant body includes connectors, inner rods, outer sleeves leaves. The number of the connectors, inner rods, outer sleeves leaves are multiple. The connectors, inner rods, outer sleeves leaves are combined with each other for use. The connectors are clamped with each other. A plurality of upper ends are mutually fixed with the leaves. Lower ends of the connectors are all mutually clamped with the inner rods. Outer surfaces of the inner rods are mutually fixed with the outer sleeves.

6 Claims, 11 Drawing Sheets

HEIGHT-ADJUSTABLE SUPPORTING STRUCTURE USED FOR ARTIFICIAL GREEN PLANT AND COMBINED CONTAINER OF HEIGHT-ADJUSTABLE SUPPORTING STRUCTURE

TECHNICAL FIELD

The present disclosure relates to the technical field of artificial green plants, in particular to a height-adjustable supporting structure used for an artificial green plant and a combined container of the height-adjustable supporting structure.

BACKGROUND

The artificial green plant is a product made of artificial materials to simulate the appearance and characteristics of real plants. The artificial green plants are very similar to real plants in appearance, but do not need to be watered frequently and may not be withered. Compared with real plants, the artificial green plants do not need to be watered and fertilized, so people do not worry about plant withering, so that a lot of money for future management is saved. With the acceleration of modern life and the pursuit of green environmental protection for people, the artificial green plant, as a low-maintenance, energy-saving and environmentally-friendly alternative product, is gradually favored by consumers and widely used in home decoration, offices, commercial places and other scenes.

At present, indoor artificial green plants in the market are usually fixed in a hollow container, and the integral stability is achieved by directly fixing the rods of the green plants at the bottom or on the inner side of the container. However, in the indoor environment, users may need to adjust the height and layout of green plants according to the difference of spaces to meet the indoor decoration requirements, but there is a lack of a solution that can not only adjust the height but also ensure the attractive appearance and stability in the prior art.

SUMMARY

Aiming at the shortages in the prior art, the present disclosure provides a height-adjustable supporting structure used for an artificial green plant and a combined container of the height-adjustable supporting structure, so that the problem the height and layout of the existing artificial green plants are difficult to adjust according to the difference of spaces is solved.

In order to achieve the above purpose, the present disclosure is realized through the following technical scheme. A height-adjustable supporting structure used for an artificial green plant includes an artificial green plant body, a lid with a height adjustment function, an outer container and an inner container. The inner container has a function of fixing the root of the artificial green plant. The artificial green plant body includes inner rods and leaves. The inner container is filled with a filler which is used for fixing the root of the green plant and is non-detachable. For the lid with a height adjustment function, in a first manner, the artificial green plant body is taken out, connectors are clamped and installed at the leaves at upper ends of the inner rods. The artificial green plant body is combined with the inner container. The lid with a height adjustment function is opened. The inner container is clamped and fixed through an inner ring slot. After clamping is completed, the lid with a height adjustment function is clamped and installed at an upper end of the outer container through clamping plates at the bottom of the lid with a height adjustment function. The artificial green plant body is inserted into the inner container to complete integral combination. In a second manner, the inner container is placed on the flat ground, and the combined artificial green plant body is inserted into the inner container so that height adjustment may be realized in a combined manner of individuals.

The number of the inner rods and the leaves are multiple, and the inner rods and the leaves are combined with each other for use.

A combined container of the height-adjustable supporting structure used for an artificial green plant includes an outer container. An upper end of the outer container is provided with a lid with a height adjustment function in a clamping manner.

Preferably, an upper end of the inner rod is fixedly provided with a plurality of leaves.

Preferably, an upper end of the small pot body is fixedly provided with a plurality of outer sleeves, and upper ends of the outer sleeves are fixedly provided with connectors.

Preferably, the lid with a height adjustment function includes a lid body, and a through hole is formed in the middle of the lid body.

Preferably, an inner ring slot is fixedly formed in the middle of the bottom surface of the lid body, and clamping plates are fixedly arranged on four sides of the bottom surface of the lid body.

Preferably, the inner ring slot is made of an elastic material.

A height-adjustable supporting structure used for an artificial green plant and a combined container of the height-adjustable supporting structure specifically include the following using steps:

S1, split transportation separating the leaves of the artificial green plant body from the outer sleeves and connectors of the inner container through the inner rods, opening the lid with a height adjustment function after separation is completed, putting the inner container and the disassembled artificial green plant body into the outer container, and putting the lid with a height adjustment function at the bottom of the outer container to be transported;

S2, integral combination taking out the artificial green plant body, clamping and installing the connectors at the leaves at upper ends of the inner rods, combining the artificial green plant body with the inner container, opening the lid with a height adjustment function, clamping and fixing the inner container through an inner ring slot, after clamping is completed, clamping and installing the lid with a height adjustment function at an upper end of the outer container through clamping plates at the bottom of the lid with a height adjustment function, and inserting the artificial green plant body into the inner container to complete integral combination; and S3, individual combination repeating the installation steps of each structure of the artificial green plant body in S2, putting the inner container on the flat ground, and inserting the combined artificial green plant body into the inner container to realize the combination of individuals.

The present disclosure provides a height-adjustable supporting structure used for an artificial green plant and a combined container of the height-adjustable supporting structure. The device has the following beneficial effects.

Firstly, the present disclosure provides a height-adjustable supporting structure used for an artificial green plant and a combined container of the height-adjustable supporting structure. When the device is used, the height of the artificial green plant may be adjusted through the simple operation that the position of an inner ring slot of the device is adjusted, so that the decoration requirements of different indoor spaces are adapted. Meanwhile, the weight of the inner container provides the basic stability of the green plant, so that toppling caused by accidental collisions or other factors may be avoided effectively no matter in living rooms, offices or other indoor scenes. The inner ring slot of the lid is made of an elastic material, the device is suitable for green plant rods and outer containers with different sizes through the design of multidimensional adjustment, and the device is of wide applicability. Moreover, all components of the green plant may be tightly stored in the hollow container, so that the transportation volume and cost may be reduced during transportation. The operation during installation is easy and simple. A cement pot is taken out from the container, the rods and leaves of the green plant are installed, and then the cement pot is fixed to an inner ring of the lid to ensure the convenience in use.

Figure 1:
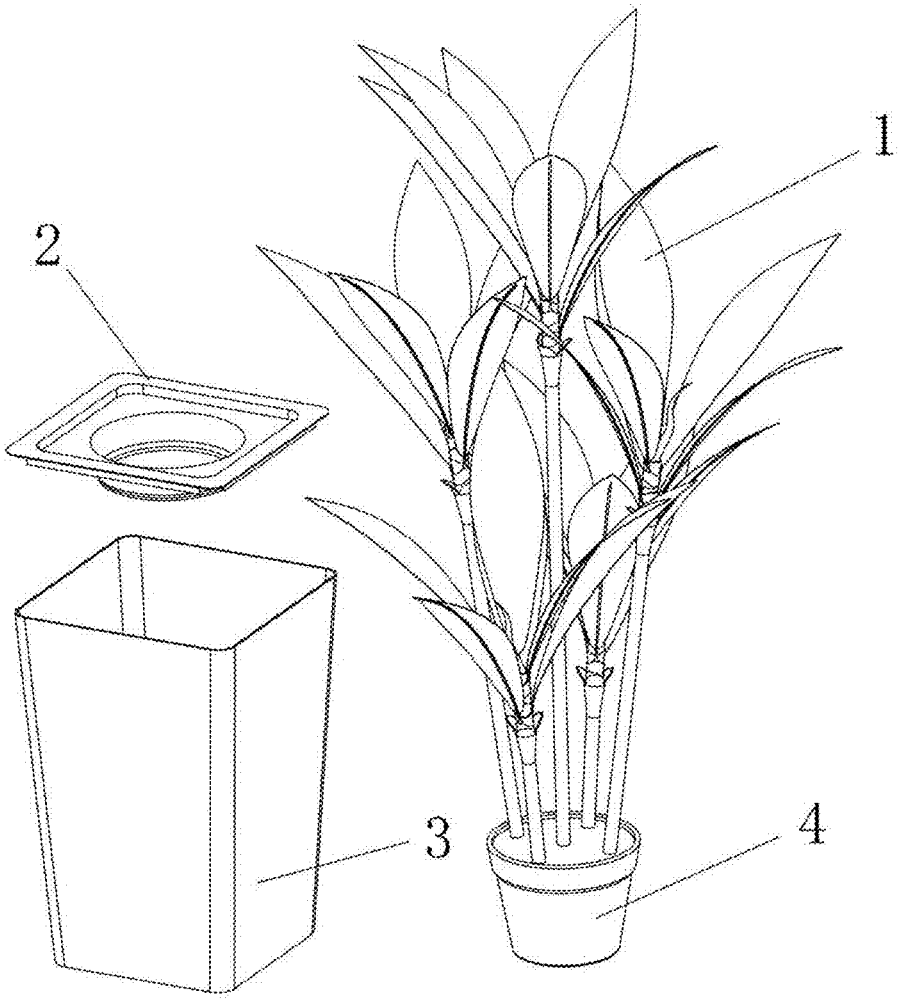
FIG. 1 is a first axonometrical schematic diagram of the present disclosure.
Figure 2:
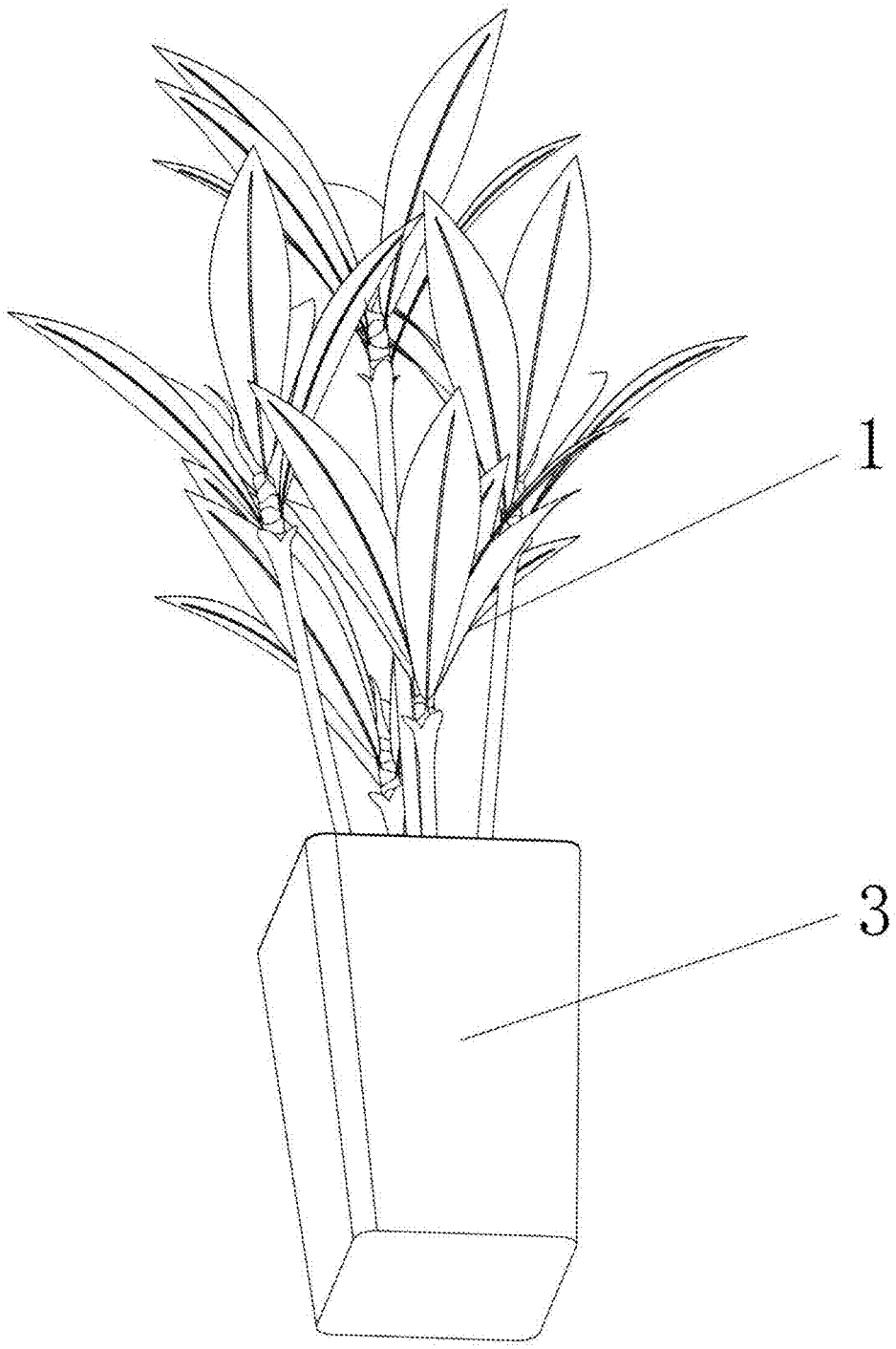
FIG. 2 is a second axonometrical schematic diagram of the present disclosure.
Figure 3:
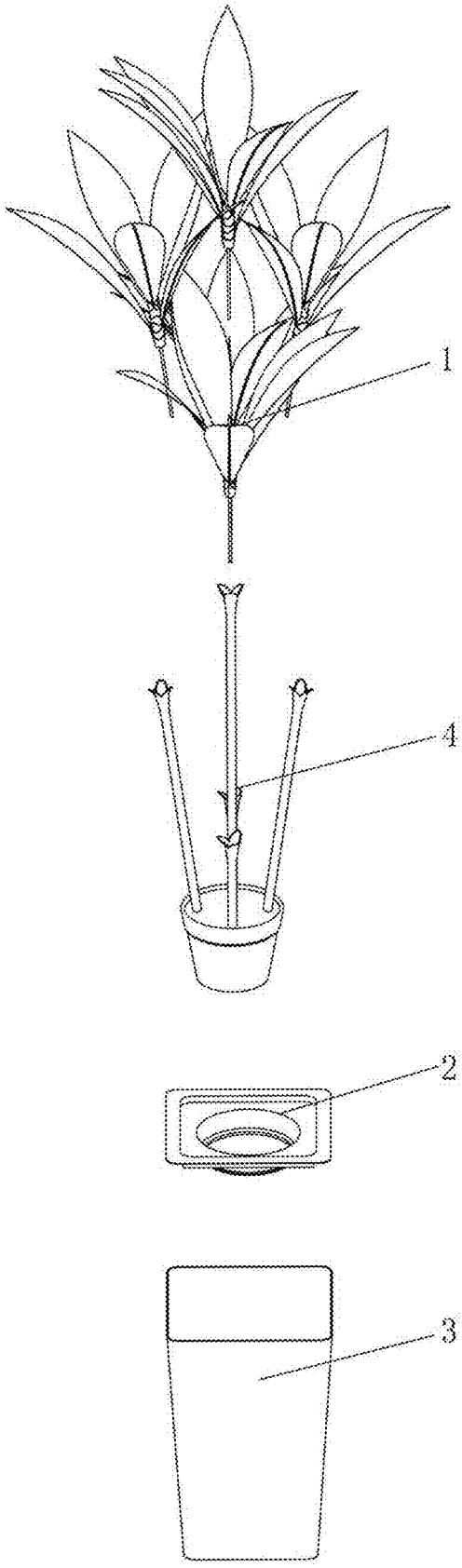
FIG. 3 is a split axonometrical schematic diagram of the present disclosure.

Reference signs: 1, artificial green plant body; 2, lid with height adjustment function; 3, outer container; 4, inner container; 101, inner rod; 102, leaf, 201, lid body; 202, through hole; 203, inner ring slot; 204, clamping plate; 401, connector; 402, outer sleeve; and 403, small pot body.

DETAILED DESCRIPTION OF THE EMBODIMENTS

The following clearly and completely describes the technical scheme in the embodiments of the present disclosure with reference to the embodiments of the present disclosure. Apparently, the described embodiments are merely a part rather than all of the embodiments of the present disclosure. Based on the embodiment in the present disclosure, all other embodiments acquired by the ordinary technical staff in the art under the premise of without contributing creative labor belong to the scope protected by the present disclosure.

As shown in FIG. 1 to FIG. 3 and FIG. 5 to FIG. 7, the embodiment of the present disclosure provides a height-adjustable supporting structure used for an artificial green plant. The height-adjustable supporting structure used for an artificial green plant includes an artificial green plant body 1, a lid 2 with a height adjustment function, an outer container 3 and an inner container 4. The artificial green plant body 1 includes inner rods 101 and leaves 102. The inner container 4 includes connectors 401, outer sleeves 402 and a small pot body 403. The artificial green plant body 1 and the inner container 4 are clamped with each other.

The number of the inner rods 101 and the leaves 102 are multiple, and the inner rods 101 and the leaves 102 are combined with each other for use. An upper end of the inner rod 101 is fixedly provided with a plurality of leaves 102. An upper end of the small pot body 403 is fixedly provided with a plurality of outer sleeves 402, and upper ends of the outer sleeves 402 are fixedly provided with connectors 401.

Specifically, the artificial green plant body 1 and the inner container 4 are combined through a plurality of structures. When the device is used by the user, all components may be put into the outer container 3 so as to reduce the transportation volume to the maximum extent. Meanwhile, during installation, only the inner container 4 needs to be taken out, and the inner rods 101 are inserted into the inner container 4 for fixation to complete assembling, so that the operation difficulty is reduced.

A combined container of the height-adjustable supporting structure used for an artificial green plant includes an outer container 3. An upper end of the outer container 3 is provided with a lid 2 with a height adjustment function in a clamping manner. The lid 2 with a height adjustment function includes a lid body 201, and a through hole 202 is formed in the middle of the lid body 201. An inner ring slot 203 is fixedly formed in the middle of the bottom surface of the lid body 201, and clamping plates 204 are fixedly arranged on four sides of the bottom surface of the lid body 201. The inner ring slot 203 is made of an elastic material.

Specifically, through the arrangement of the outer container 3, an inner cavity of the outer container 3 is enough to accommodate the inner container 4. Meanwhile, there is no fixing device at the bottom of the outer container 3, so that the inner container 4 may move inside the container freely. Through the arrangement of the inner container 4, one end of the artificial green plant body 1 is fixed into the removable inner container 4. The size of the inner container 4 is such designed that the inner container 4 is properly inserted into the outer container 3. Meanwhile, the weight of the inner container 4 provides the main support and stability of the green plant. Through the arrangement of the lid 2 with a height adjustment function, the lid 2 with a height adjustment function includes an inner ring slot 203 for clamping an upper edge of the inner container 4. The lid body 201 may be tightly combined with the inner side of the outer container 3 through the clamping plates 204. During installation, the user can take out the inner container 4 from the outer container 3. The height of the green plant is increased by adjusting the position of the inner ring slot 203. The inner ring slot 203 is made of an elastic material. The user may adjust the integral height of the device according to indoor layout requirements by changing or adjusting the position of the inner ring slot 203, so that an optimum ornamental effect is achieved.

Figure 4:
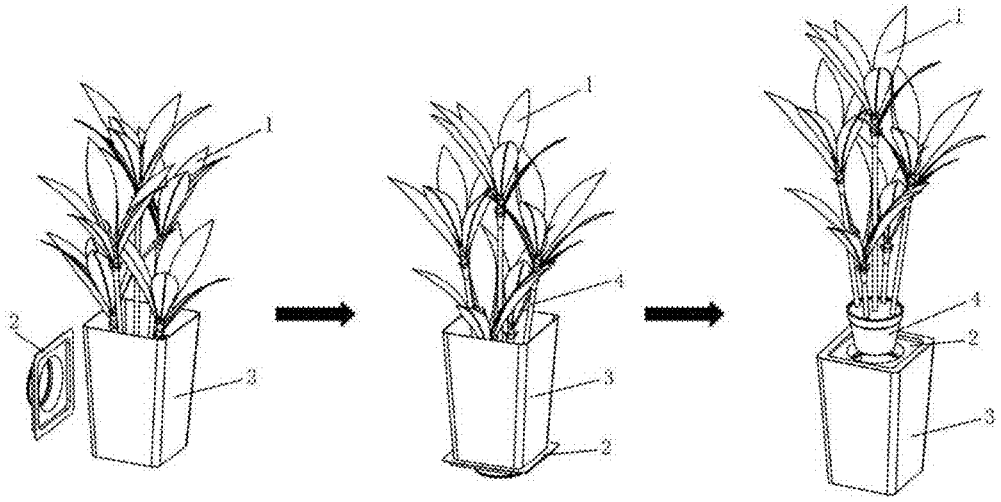
FIG. 4 is a schematic diagram of an installation procedure of the present disclosure.
Figure 5:
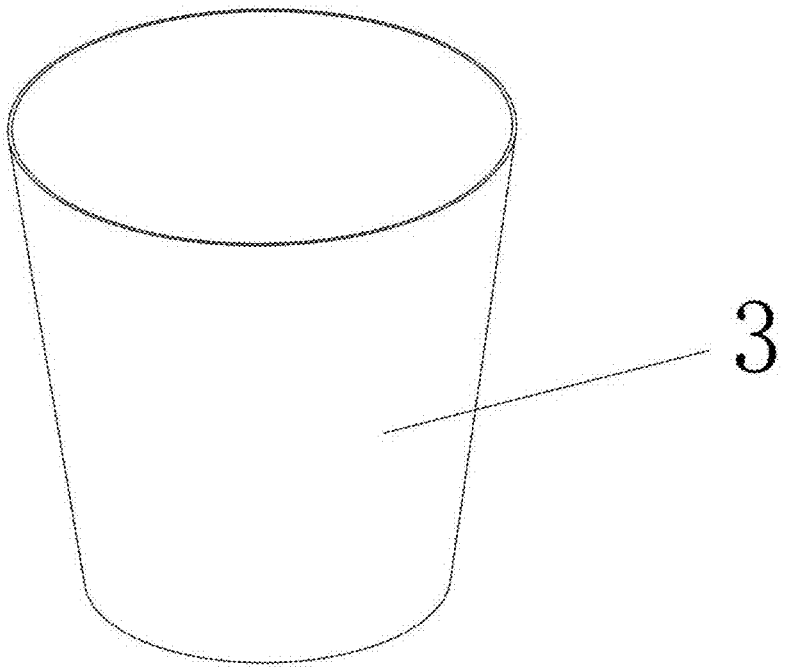
FIG. 5 is a schematic diagram of an outer container in another form in the present disclosure.
Figure 6:
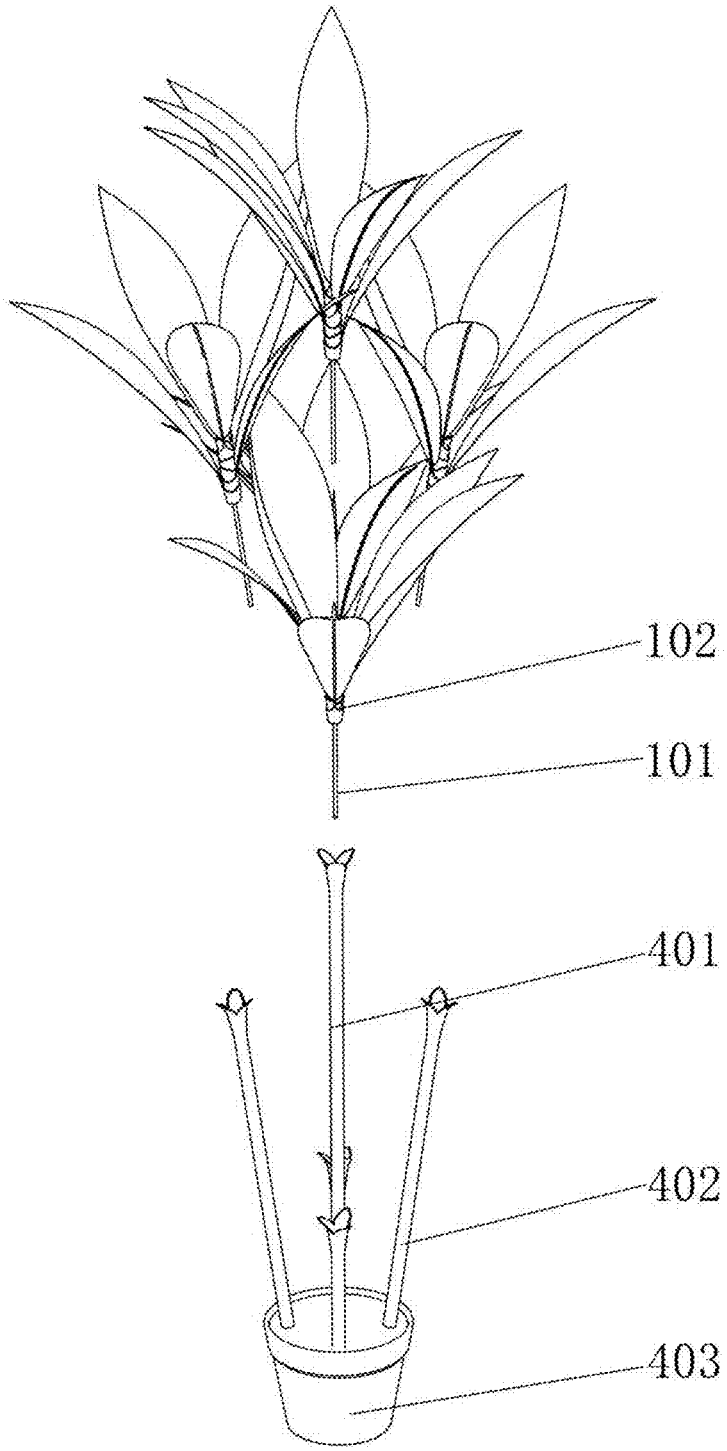
FIG. 6 is an axonometrical schematic diagram of an artificial green plant body in the present disclosure.
Figure 7:
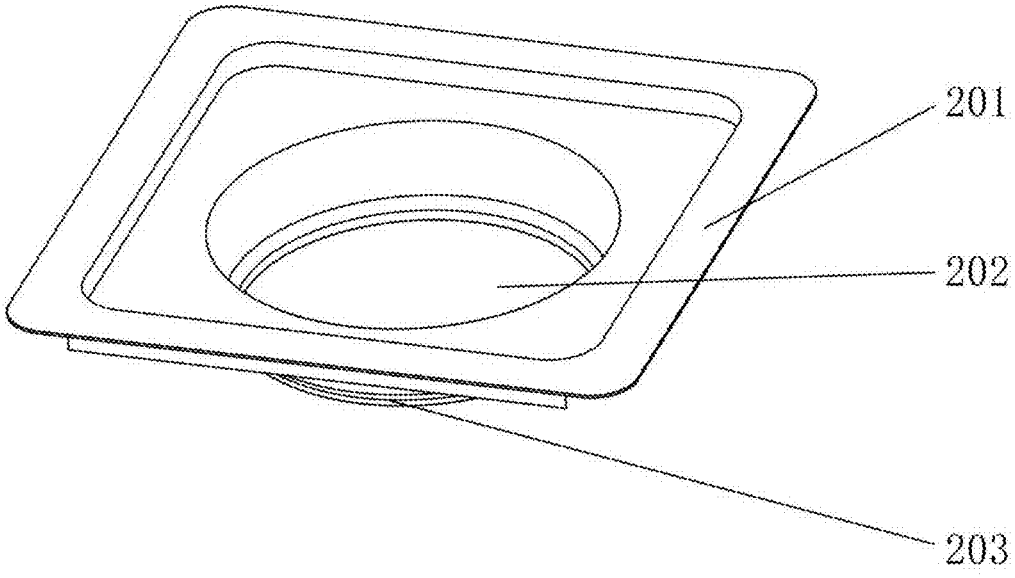
FIG. 7 is a first axonometrical schematic diagram of a lid with a height adjustment function in the present disclosure.
Figure 8:
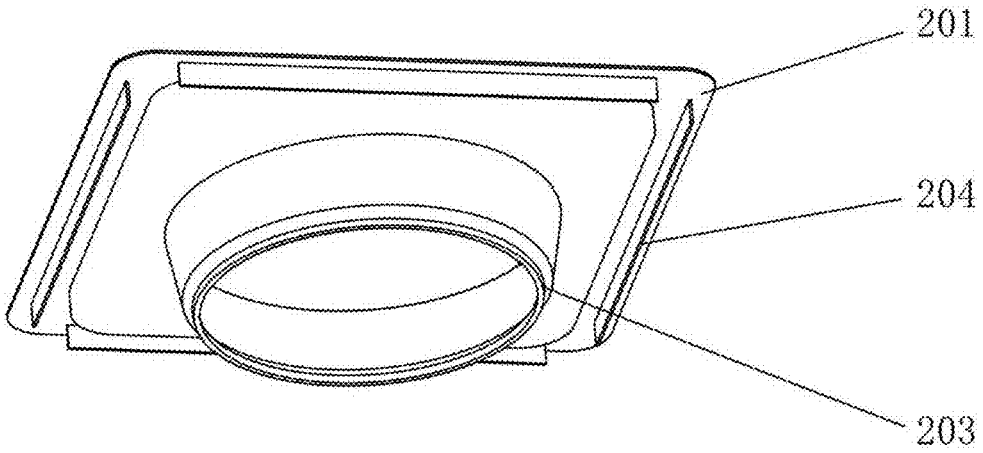
FIG. 8 is a second axonometrical schematic diagram of a lid with a height adjustment function in the present disclosure.
Figure 9:
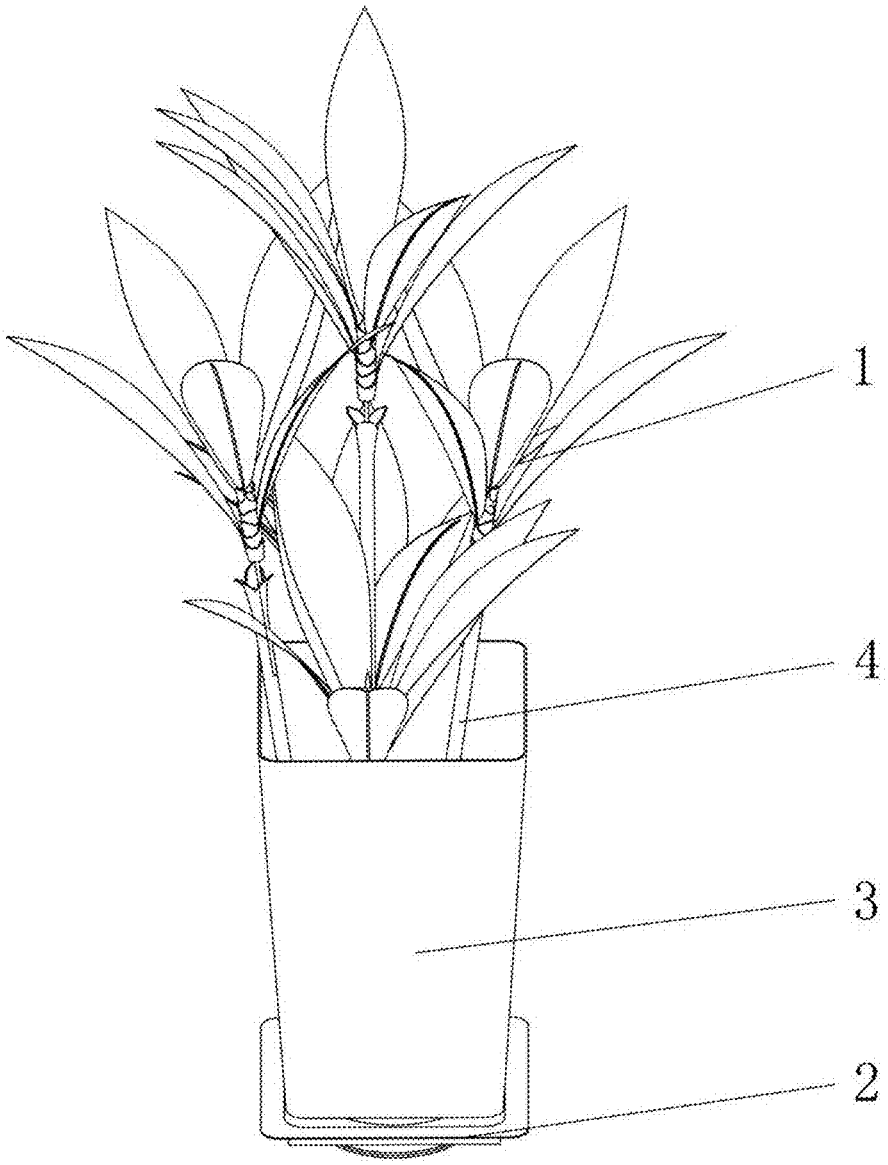
FIG. 9 is an axonometrical schematic diagram of a transportation state in the present disclosure.
Figure 10:
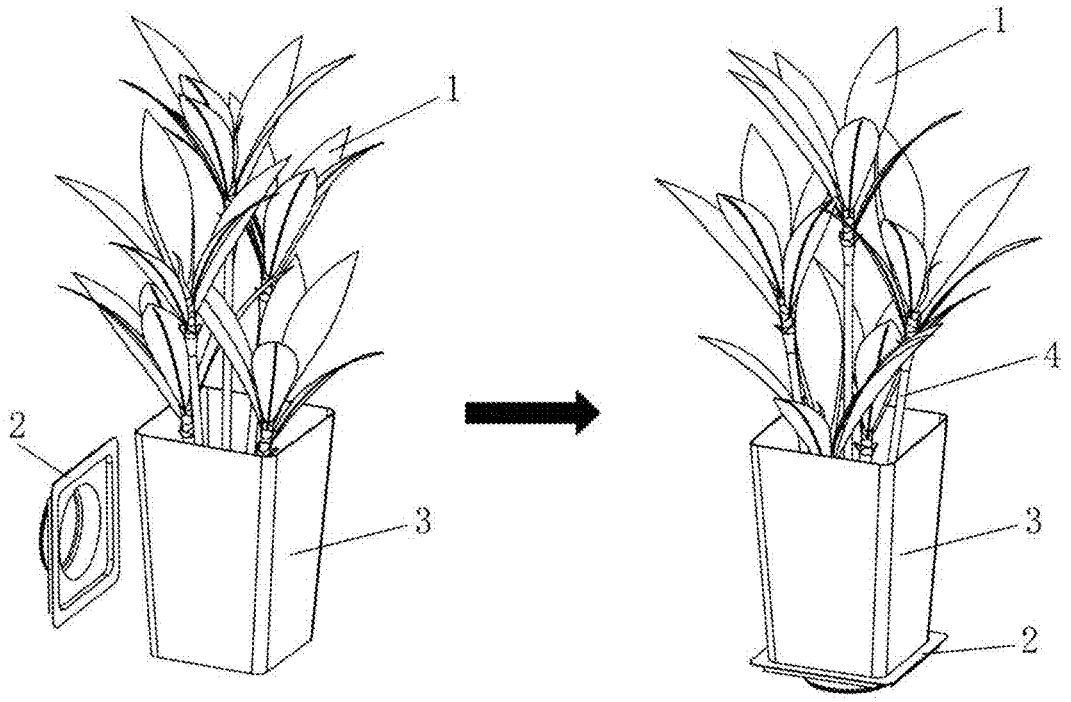
FIG. 10 is a schematic diagram of a first height adjustment manner in the present disclosure.
Figure 11:
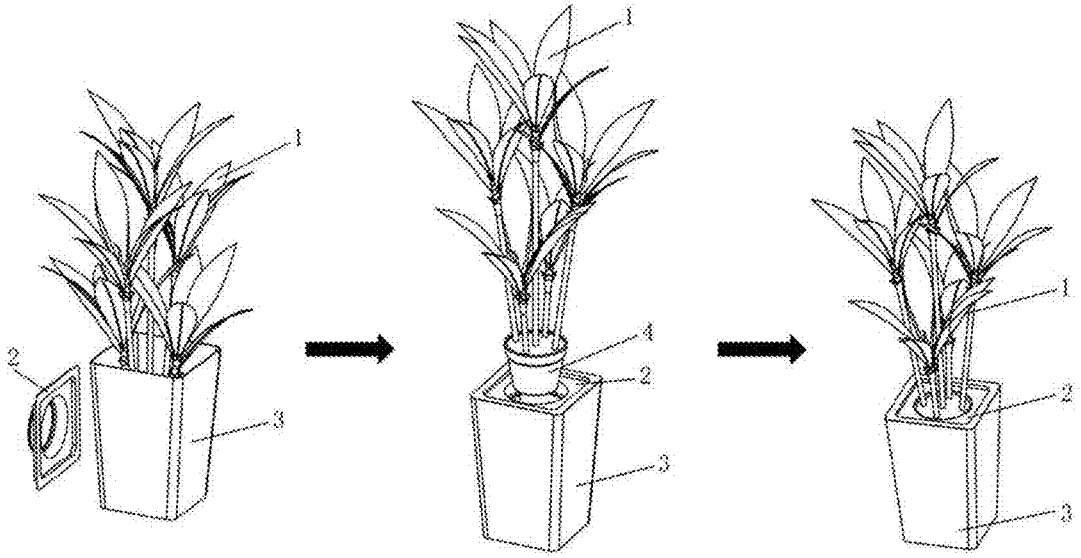
FIG. 11 is a schematic diagram of a second height adjustment manner in the present disclosure.

As shown in FIG. 4, a height-adjustable supporting structure used for an artificial green plant and a combined container of the height-adjustable supporting structure specifically include the following using steps:

S1, split transportation separating the leaves 102 of the artificial green plant body 1 from the outer sleeves 402 and connectors 401 of the inner container 4 through the inner rods 101, opening the lid 2 with a height adjustment function after separation is completed, putting the inner container 4 and the disassembled artificial green plant body 1 into the outer container 3, and putting the lid 2 with a height adjustment function at the bottom of the outer container 3 to be transported;

S2, integral combination taking out the artificial green plant body 1, clamping and installing the connectors 401 at the leaves 102 at upper ends of the inner rods 101, combining the artificial green plant body 1 with the inner container 4, opening the lid 2 with a height adjustment function, clamping and fixing the inner container 4 through an inner ring slot 203, after clamping is completed, clamping and installing the lid 2 with a height adjustment function at an upper end of the outer container 3 through clamping plates 204 at the bottom of the lid 2 with a height adjustment function, and inserting the artificial green plant body 1 into the inner container 4 to complete integral combination; and S3, individual combination repeating the installation steps of each structure of the artificial green plant body 1 in S2, putting the inner container 4 on the flat ground, and inserting the combined artificial green plant body 1 into the inner container 4 to realize the combination of individuals.

Specifically, through mutual combination of individual combination and integral combination, when the device is used integrally, the user may adjust the integral height of the device according to respective using requirements, so that the device may be suitable for various different use environments. Meanwhile, the device is integrally split and put into the outer container 3 for storage, so that the device is more convenient to transport.

Although the embodiments of the present disclosure have already been illustrated and described, various changes, modifications, replacements and transformations can be made by those skilled in the art under the condition of without departing from the principle and the spirit of the present disclosure, and thus the scope of the present disclosure should be restricted by claims and equivalents thereof.

What is claimed is:

1. A height-adjustable supporting structure used for an artificial green plant, comprising an artificial green plant body (1), a lid (2) with a height adjustment function, an outer container (3) and an inner container (4), wherein the inner container (4) has a function of fixing the root of the artificial green plant, the artificial green plant body (1) comprises inner rods (101) and leaves (102), the inner container (4) is filled with a filler which is used for fixing the root of the green plant and is non-detachable, for the lid (2) with a height adjustment function, in a first manner, the artificial green plant body (1) is taken out, connectors (401) are clamped and installed at the leaves (102) at upper ends of the inner rods (101), the artificial green plant body (1) is combined with the inner container (4), the lid (2) with a height adjustment function is opened, the inner container (4) is clamped and fixed through an inner ring slot (203), after clamping is completed, the lid (2) with a height adjustment function is clamped and installed at an upper end of the outer container (3) through clamping plates (204) at the bottom of the lid (2) with a height adjustment function, the artificial green plant body (1) is inserted into the inner container (4) to complete integral combination, and in a second manner, the inner container (4) is placed on the flat ground, and the combined artificial green plant body (1) is inserted into the inner container (4) so that height adjustment may be realized in a combined manner of individuals;

the number of the inner rods (101) and the leaves (102) are multiple, and the inner rods (101) and the leaves (102) are combined with each other for use;

a combined container of the height-adjustable supporting structure used for an artificial green plant, comprising an outer container (3), wherein an upper end of the outer container (3) is provided with a lid (2) with a height adjustment function in a clamping manner;

the lid (2) comprises a lid body (201) and four of the clamping plates (204) that are respectively fixedly arranged on four sides of a bottom surface of the lid body (201), the inner ring slot (203) is fixedly formed in the middle of the bottom surface of the lid body (201) and beneath the lid body (201); in the first manner, the lid body (201) abuts against a upper end of the outer container (3) and the four clamping plates (204) abuts against four inner sides of the outer container (3) respectively; an upper edge of the inner container (4) is clamped in the inner ring slot (203).

2. The height-adjustable supporting structure used for an artificial green plant according to claim 1, wherein an upper end of the inner rod (101) is fixedly provided with a plurality of leaves (102).

3. The height-adjustable supporting structure used for an artificial green plant according to claim 1, wherein an upper end of a small pot body (403) is fixedly provided with a plurality of outer sleeves (402), and upper ends of the outer sleeves (402) are fixedly provided with connectors (401).

4. The height-adjustable supporting structure used for an artificial green plant according to claim 3, wherein a through hole (202) is formed in the middle of the lid body (201).

5. The height-adjustable supporting structure used for an artificial green plant according to claim 1, wherein the inner ring slot (203) is made of an elastic material.

6. The height-adjustable supporting structure used for an artificial green plant according to claim 3, wherein the inner rod (101) penetrates through the connector (401) and is fully accommodated inside the outer sleeves (402).

* * * * *